252-103 AU 166 EX
3/20/84 XP 4,438,016

United States Patent [19]
Kiewert et al.
[11] 4,438,016
[45] Mar. 20, 1984

[54] STABLE AQUEOUS CLEANING AGENTS AND A PROCESS FOR THEIR PRODUCTION

[75] Inventors: Eva Kiewert, Dusseldorf; Karlheinz Disch, Haan, both of Fed. Rep. of Germany

[73] Assignee: Henkel Kommanditgesellschaft Auf Aktien, Dusseldorf-Holthausen, Fed. Rep. of Germany

[21] Appl. No.: 475,869

[22] Filed: Mar. 16, 1983

[30] Foreign Application Priority Data

Oct. 29, 1982 [DE] Fed. Rep. of Germany ..... 3240088

[51] Int. Cl.³ ..... C11D 3/12

[52] U.S. Cl. ..... 252/174.25; 252/103; 252/140; 252/155; 252/DIG. 14; 423/328; 423/329; 423/331

[58] Field of Search ..... 252/174.25, 140, 155, 252/103, DIG. 14; 423/328, 329, 331

[56] References Cited

U.S. PATENT DOCUMENTS

| | | | |
|---|---|---|---|
| 4,072,622 | 2/1978 | Kuhling et al. | 252/DIG. 14 |
| 4,154,694 | 5/1979 | Donaldson | 252/DIG. 14 |
| 4,208,295 | 6/1980 | Sai et al. | 252/174.25 |
| 4,271,135 | 6/1981 | Wuest et al. | 423/328 |
| 4,377,502 | 3/1983 | Klotz | 423/328 |

FOREIGN PATENT DOCUMENTS

| | | |
|---|---|---|
| 57-61615 | 3/1982 | Japan . |
| 57-67697 | 3/1982 | Japan . |
| 57-73097 | 5/1982 | Japan . |
| 1365318 | 8/1974 | United Kingdom . |
| 2071632 | 9/1981 | United Kingdom . |

*Primary Examiner*—John E. Kittle
*Assistant Examiner*—Hoa V. Le
*Attorney, Agent, or Firm*—Hammond & Littell, Weissenberger and Muserlian

[57] ABSTRACT

Stable, aqueous cleaning agents containing (a) anionic and/or nonionic surfactants, optionally chlorine-stable, (b) an abrasive component and/or (c) an active-chlorine-releasing compound and, optionally, (d) dyes and (e) fragrances, characterized in (f) a further content of amorphous calcium aluminum silicates precipitated in situ; and the process of their preparation wherein the various ingredients are mixed and the amorphous calcium aluminum silicates are formed by precipitation therein.

8 Claims, No Drawings

STABLE AQUEOUS CLEANING AGENTS AND A PROCESS FOR THEIR PRODUCTION

BACKGROUND OF THE INVENTION

This invention relates to aqueous cleaning liquids or pastes which are stable both in their effect and in storage and which contain in particular chlorine-stable surfactants, an abrasive component and/or an active chlorine donor, dyes and fragrances and also amorphous calcium aluminum silicate precipitated in situ.

Large quantities of scouring agents are used in the cleaning of heavily soiled, mechanically resistant surfaces both in the home and in industry. Bleaching and non-bleaching scouring powders in a ratio of approximately 50:50 are available on the market for this purpose. At the present time, non-bleaching scouring powders are being replaced to an increasing extent by scouring liquids. Hitherto, however, a geniune, liquid and bleaching scouring agent has never been available on the market. The reason for this would appear to lie in the difficulty of formulating products of this type in a form in which both the suspension itself and also its active bleaching component remain stable.

Combined bleaching and cleaning or scouring agents are supposed to develop this bleaching and cleaning or scouring effect in a very short space of time, that is, during their use and at room temperature. Compounds which release active chlorine are commercially available as bleaching components for liquid agents of the type in question which satisfy these requirements and of which the loss of activity in aqueous solution is tolerable. Now, to produce a liquid cleaning or scouring agent, particularly one based on compounds of the above-mentioned type, it was necessary to find a medium which is unaffected above all by aqueous solutions containing active chlorine and which on the one hand is capable of permanently suspending even particles of abrasive and, on the other hand, shows surface-active properties so that, in addition to the pure scouring and/or bleaching effect, the liquid cleaning or scouring agent also develops the cleaning effect, with respect to fat-containing soil, required by the consumer.

U.S. Pat. No. 4,248,728 already describes scouring pastes containing crystalline sodium aluminum silicate and optionally compounds containing active chlorine and/or mineral abrasives. Although abrasive-containing scouring pastes can be obtained in accordance with the teaching of this U.S. Patent using additions of swellable magnesium aluminum silicate, the abrasives settle out irreversibly after storage to form a solid sediment, despite vague statements to the contrary. As a result of this phenomenon, the product can no longer be used.

According to U.S. Pat. No. 4,235,732, expandable clays are used for stabilizing suspensions of hypochlorite-containing liquid scouring agents. However, expandable clays are attended by the disadvantage that they have such a strong thickening effect that they can only be used in small quantities and are only suitable for stabilizing suspensions of abrasives of lower specific gravity, namely the expanded perlites preferably and exclusively used in the above-mentioned U.S. Patent. However, they cannot be used for stabilizing abrasives of higher specific gravity, such as powdered quartz or marble, which are also mentioned therein and are normally used in genuine scouring agents, in the quantities required to obtain an adequate scouring effect. Abrasives as heavy as these settle even through thixotropic pastes and form an irreversible deposit. Another disadvantage lies in the fact that, on account of their natural origin, these expandable clays generally contain small quantities of impurities which, through catalytic reactions, accelerate the decomposition of compounds containing active chlorine in aqueous solution and, hence, adversely affect their long-term stability of action in the liquid cleaning or scouring agents.

Published European Patent application No. 0 009 942 A 1 also describes pourable liquid active-chlorine-containing scouring agents which contain a combination of anionic and nonionic or ampholytic surfactants and an electrolyte. However, the stability of these scouring agent suspensions with respect to chlorine is inadequate for retail products.

OBJECTS OF THE INVENTION

An object of the present invention is the development of stable, aqueous cleaning agents containing surfactants, an abrasive component and/or an active-chlorine-releasing compound which is stable with respect to sedimentation and with respect to chlorine release.

Another object of the present invention is the development of a stable, aqueous cleaning agent composition comprising (a) a surfactant-effective amount of a surfactant selected from the group consisting of non-chlorine-stable anionic surfactants, non-chlorine-stable nonionic surfactants, chlorine-stable anionic surfactants, chlorine-stable nonionic surfactants and mixtures thereof, (b) from 0 to an abrasively-effective amount of at least one abrasive component, (c) from 0 to a bleaching-effective amount of an active-chlorine-releasing compound and (d) from 0 to an effective amount of dyes and (e) from 0 to an effective amount of fragrances, with (f) a further suspending-effective amount of an amorphous calcium aluminum silicate precipitated in situ, where an effective amount of at least one of component (b) and component (c) is present.

A further object of the present invention is the development of a process for the production of a stable, aqueous cleaning agent composition comprising (a) a surfactant-effective amount of a surfactant selected from the group consisting of non-chlorine-stable anionic surfactants, non-chlorine-stable nonionic surfactants, chlorine-stable anionic surfactants, chlorine-stable nonionic surfactants and mixtures thereof, (b) from 0 to an abrasively-effective amount of at least one abrasive component, (c) from 0 to a bleaching-effective amount of an active-chlorine-releasing compound and (d) from 0 to an effective amount of dyes and (e) from 0 to an effective amount of fragrances, with (f) a further suspending-effective amount of an amorphous calcium aluminum silicate precipitated in situ, where an effective amount of at least one of component (b) and component (c) is present, comprising the steps of mixing component (b) if present, with an aqueous solution of component (a) and component (d) if present, at room temperature, then successively adding under continuous mixing a calcium chloride solution, an aluminum hydroxide solution and a waterglass solution in amounts sufficient to form said component (f) in situ, followed by adding components (c), if present, and component (e), if present, and recovering said stable, aqueous cleaning agent composition.

These and other objects of the invention will become more apparent as the description thereof proceeds.

DESCRIPTION OF THE INVENTION

It has now been found that aqueous cleaning or scouring liquids or pastes which are stable both in their effect and in storage and which contain anionic and/or nonionic, particularly chlorine-stable surfactants and an abrasive component and/or a compound containing active chlorine can be obtained by the addition of amorphous calcium aluminum silicates which are precipitated in situ, optionally in the presence of the abrasive preferably present.

More particuarly, the present invention relates to a stable, aqueous cleaning agent composition comprising (a) a surfactant-effective amount of a surfactant selected from the group consisting of non-chlorine-stable anionic surfactants, non-chlorine-stable nonionic surfactants, chlorine-stable anionic surfactants, chlorine-stable nonionic surfactants and mixtures thereof, (b) from 0 to an abrasive-effective amount of at least one abrasive component, (c) from 0 to a bleaching-effective amount of an active-chlorine-releasing compound and (d) from 0 to an effective amount of dyes and (e) from 0 to an effective amount of fragrances, with (f) a further suspending-effective amount of an amorphous calcium aluminum silicate precipitated in situ, where an effective amount of at least one of component (b) and component (c) is present.

The suspension-stabiliting effect of calcium-aluminum-silicate precipitated in situ was hitherto unknown and was not foreseeable to the expert. The calcium aluminum silicate occurs in X-ray amorphous form, is not swellable in water and does not of course have any complexing effect with respect to ions responsible for hardness in tapwater. By virtue of these properties, it cannot be compared with other silicates of the type commonly used as constituents of cleaning agents.

Apart from the chemical differences between the silicates known from the literature and successfully used in practice and the claimed calcium aluminum silicate, a crucial feature of the present invention lies in the fact that the calcium aluminum silicate is produced in situ, preferably in the presence of abrasives. If it is separately produced and subsequently added to the liquid cleaning or scouring agent, the suspension-stabilizing effect is distinctly weaker. Photographs taken with a scanning electron microscope show that, with calcium aluminum silicate precipitated in situ $CaCO_3$ particles used as abrasives for example in scouring agents according to the invention are coated with a uniform layer of smaller solid particles. By contrast, if the same quantity of pre-precipitated calcium aluminum silicate is subsequently added or if a corresponding quantity of standard commercial hectorite clay (sodium magnesium silicate) is added to otherwise the same composition, the $CaCO_3$ particles remain unchanged as a mixture with the smaller solid particles.

In one particular embodiment, the agents according to the invention may also contain dyes and fragrances which should be stable with respect to any chlorine present.

Accordingly, the present invention relates to aqueous cleaning or scouring liquids or pastes which are stable both in their effect and in storage and which contain (a) from 1 to 10% by weight and preferably from 2 to 6% by weight of anionic and/or nonionic surfactants optionally chlorine-stable, (b) from 0 to 10% by weight and preferably from 0.1 to 2% by weight of active chlorine, (c) from 0 to 60% by weight and preferably from 10 to 50% by weight of an abrasive component having a particle size of from 1 to 200μ, (d) from 5 to 20% by weight and preferably from 5 to 15% by weight of calcium aluminum silicate precipitated in situ, optionally in the presence of the abrasive component, (e) balance to 100% by weight of fully deionized water and, optionally, dyes and fragrances, where at least one constituents (b) and (c) have to be present.

The present invention also relates to a process for the production of aqueous cleaning or scouring liquids or pastes which are stable both in their effect and in storage and which contain anionic and/or nonionic surfactants, optionally chlorine-stable, an abrasive component and/or an active-chlorine-releasing compound and, optionally, dyes and fragrances, characterized in that the abrasive component is optionally stirred at room temperature into an aqueous solution of the surfactants and, optionally, the dyes, followed by the successive addition with continued stirring of a calcium chloride solution, an aluminum hydroxide solution, a waterglass solution and, optionally the chlorine liquor and the fragrance.

More particularly, the invention relates to a process for the production of a stable, aqueous cleaning agent composition comprising (a) a surfactant-effective amount of a surfactant selected from the group consisting of non-chlorine-stable anionic surfactants, non-chlorine-stable nonionic surfactants, chlorine-stable anionic surfactants, chlorine-stable nonionic surfactants and mixtures thereof, (b) from 0 to an abrasively-effective amount of at least one abrasive component, (c) from 0 to a bleaching-effective amount of an active-chlorine-releasing compound and (d) from 0 to an effective amount of dyes and (e) from 0 to an effective amount of fragrances, with (f) a further suspending effective amount of an amorphous calcium aluminum silicate precipitated it situ, where an effective amount of at least one component (b) and component (c) is present.

If the end product is to be adjusted to a certain pH-value which, in the case of chlorine-containing cleaning agents, should not be below 11.5 for the well known reason of chlorine stability, the pH-value in question may be adjusted by adding a chlorine-stable acid, such as for example hydrochloric acid, phosphoric acid or phosphonobutane tricarboxylic acid, between the addition of the aluminate solution and the addition of the waterglass solution.

Although the actual value of the present invention lies in the suspension stabilization of abrasives having particle sizes of up to 200μ in liquid scouring agents, it is also possible to produce an abrasive-free cleaning agent using the calcium aluminum silicate according to the invention. In that case, a thickened, thioxtropic, preferably chlorine-containing cleaning agent having an extremely mild abrasive effect is obtained. Compared with conventional abrasive-free chlorine-containing cleaning liquids, a product such as this has the advantage of better adhesion to vertical surfaces which has a positive bearing upon the quality of the bleaching effect. Cleaners of this type are known, for example, from U.S. Pat. No. 4,116,849.

The individual components of the claimed scouring agents may be charazterized as follows:

Suitable surfactants are any of the anionic and/or nonionic compounds commonly used in cleaning agents.

(a) Suitable chlorine-stable surfactants are, for example, $C_8$–$C_{22}$- and preferably $C_{10}$–$C_{18}$-alkane sulfonates, $C_8$–$C_{15}$- and preferably $C_{10}$–$C_{13}$-alkyl benzene sulfonates, $C_8$–$C_{18}$- and preferably $C_{12}$–$C_{16}$-alkyl sulfates, betaines and $C_{10}$–$C_{18}$-alkyl dimethyl aminoxides. It is preferred to use a mixture of one of the above-mentioned anionic surfactants, particularly an alkane sulfonate, and an aminoxide, because of mixtures such as these form slightly viscous solutions in the presence of chlorine bleaching liquor. This slight viscosity has an additional positive effect upon the suspension stability of the final liquid chlorine-containing scouring agents, but is not in itself sufficient to keep the abrasive in homogeneous distribution without the other stabilizing system according to the invention. The same favorable low inherent viscosity of individual surfactant components can be achieved by adding to them small quantities of known thickeners of the acrylate or methacrylate copolymer type.

(b) Known active chlorine compounds which form hypochlorite in aqueous solution are Na, Li and Ca hypochlorite and also organic chlorine donors, such as Chloramine-T and Chlorinated Isocyanurates. Standard commercial chlorine bleaching liquors having an active chlorine content of from 12 to 16% by weight are preferred.

(c) Depending on the required scouring effect, suitable abrasives are those having a relatively soft grain, such as marble dust, kieselguhrs and the like, or those having a hard grain, such as perlite, quartz or cristobalite in powder form. Although there is no preference for any one mineral, the abrasive component must be stable to alkalis and, optionally to chlorine, in addition to which steps must be taken to ensure that powder-form minerals emanating from natural sources contain impurities in only such small quantities that they do not promote the catalytic decomposition of chlorine bleaching liquor. The particle size depends upon the required scouring effect. The particle size range may be between 1 and 200μ. A particle size range from 1 to 100μ is particularly suitable for liquid scouring agents which are intended for general cleaning work in the home.

(d) The calcium aluminum silicate to be precipitated in situ may be produced from inexpensive starting materials which likewise must be substantially free from heavy metals and organic impurities. Advantageous starting materials are calcium chloride, aluminum hydroxide and waterglass. The starting materials are used in such quantitative ratios to one another that the molar ratios of CaO to $Al_2O_3$ to $SiO_2$ in the formulation amount to about 1:1:2.

(e) The choice of dyes and fragrances is determined by their stability in hypochlorite-containing solution. Accordingly, suitable dyes are, for example, phthalocyanines or ultramarine blue. Suitable fragrances are described, for example, in U.S. Pat. No. 3,876,551.

The cleaning agents according to the invention are white, opague suspensions which, even after prolonged storage, undergo such little separation, if any, that they maybe rehomogenized by gentle shaking before use.

The cleaning agents according to the invention are applied by squeezing out from flexible plastic bottles or tubes.

The following examples are illustrative of the invention without being limitative.

EXAMPLE 1

Composition in % by weight:

6% of dimethyl coconutalkyl aminoxide, 30% active substance,

4% of sec. $C_{11}$–$C_{15}$-alkane sulfonate, Na-salt, 60% active substance,

5% of chlorine bleaching liquor, 12 to 16% of active chlorine.

25% of calcium carbonate, particle size 1–100μ

8.3% of calcium aluminum silicate precipitated in situ 0.01% of Cu-phthalocyanine dye 0.2% of perfume oil balance water, fuly deionized.

The claimed process for producing the agents according to the invention was applied as follows:

First the following three solutions were prepared:

I. an aluminate solution prepared from 19.7% by weight of hydragillite, technical quality, 88% of $Al(OH)_3$, 53.6% by weight of 50% NaOH solution and 26.7% by weight of fully deionized water II. a $CaCl_2$ solution prepared from 24% by weight of $CaCl_2.6H_2O$ and 76% by weight of water, fully deionized and III. sodium waterglass, 34.5%, molar ratio of $SiO_2$ to $Na_2O$=3.85.

The surfactants, the abrasives and the dye were then stirred into water at room temperature. 10% by weight of solution II, 10% by weight of solution I, 5% by weight of solution III and also the chlorine liquor and the perfume oil were then successively added with continuous stirring to the homogeneous suspension thus obtained.

The liquid scouring agent obtained was thixotropic and had a relatively mild abrasive effect and a very strong bleaching effect. After storage for 3 months at room temperature, the suspension was unchanged and the loss of chlorine amounted to only 22%.

In the absence of the calcium aluminum silicate precipitated in situ and in the absence of other stabilizers, the abrasive component sedimented after brief storage and, although it could be shaken up, soon settled out again. Accordingly, the end product was of no interest for commercial use.

The same applied when standard commercial hectorite (sodium magnesium silicate) was added instead of this calcium aluminum silicate.

It was also particularly surprising to find that a separately and freshly precipitated calcium aluminum silicate also resulted in early phase separation when subsequently combined with the suspension of the remaining constituents of the scouring agent.

EXAMPLE 2

Composition:

2% by weight of $C_{10}$–$C_{13}$ alkyl benzene sulfonate, Na-salt,

6% by weight of aminoxide, 30% solution as in Example 1, 0.5% by weight of Chloramine-T 10% by weight of expanded perlite, average particle diameter 7μ

5.6% by weight of calcium aluminum silicate precipitated in situ balance water, fully deionized.

Production was carried out in the same way as in Example 1.

The end product was a thixotropic, mildy abrasive scouring paste. After storage for 3 months, the suspension was still homogeneous, its active chlorine content having remained substantially the same.

EXAMPLE 3

Composition:

4% by weight of alkane sulfonate, Na-salt, 60% solution as in Example 1,
6% by weight of dimethyl coconutalkyl aminoxide, 30% active substance,
5% by weight of chlorine bleaching liquor, 12 to 16% of active chlorine
25% by weight of crystalobite powder, particle size 1–100μ
8.3% by weight of calcium aluminum silicate precipitated in situ
0.1% by weight of fragrance
balance water, fully deionized.

Production was carried out in the same way as in Example 1.

The end product was a liquid, powerfully abrasive scouring agent. The suspension did not deteriorate on storage and retained its stability to chlorine. After 3 months, the loss of active chlorine amounted to approximately 24%.

EXAMPLE 4

Composition:

2% by weight of alkane sulfonate; Na-salt, 60% solution as in Example 1
3% by weight of aminoxide, 30% solution, as in Example 1,
5% by weight of chlorine bleaching liquor, 12 to 16% of active chlorine,
25% by weight of marble powder, particle size 1–100μ,
13% by weight of calcium aluminum silicate precipitated in situ,
0.1% by weight of fragrance
balance water, fully deionized.

Production was again carried out as in Example 1.

The liquid scouring agent was as good in its properties as the scouring agent produced in accordance with Example 1. The loss of active chlorine after storage for 3 months at room temperature amounted to only about 20%.

EXAMPLE 5

Composition:

4.0% by weight of alkane sulfonate Na-salt, 60% solution, as in Example 1,
6.0% by weight of aminoxide, as in Example 1,
5.0% by weight of chlorine bleaching liquor, 12 to 16% of active chlorine,
45.0% by weight of marble powder, average particle diameter 15μ,
5.6% by weight of calcium aluminum silicate precipitated in situ,
0.2% by weight of fragrance,
balance water, fully deionized.

Production was carried out in the same way as in Example 1.

The end product was a moderately abrasive scouring paste which showed high stability in storage as such and in storage as such and in regard to its active chlorine content. After 3 months at room temperature, the chlorine loss amounted to approximately 27%.

EXAMPLE 6

Composition:

4.0% by weight of alkane sulfonate, Na-salt, 60% solution as in Example 1,
6.0% by weight of aminoxide, as in Example 1,
5.0% by weight of chlorine bleaching liquor, 12 to 16% of active chlorine,
13.0% by weight of calcium aluminum silicate precipitated in situ
0.2% by weight of fragrance
balance water, fully deionized.

This abrasive-free, active-chlorine-containing, thickened cleaning agent was also produced as in Example 1. Even after a storage for 6 months, this paste, which adhered firmly even to vertical surfaces, was still homogeneous and showed a chlorine loss of less than 50%.

EXAMPLE 7

Composition:

2.5% by weight of alkane sulfonate Na-salt, 60% solution as in Example 1,
2.0% by weight of aminoxide, as in Example 1,
40.0% by weight of marble powder, particle size 1–100μ,
5.0% by weight of calcium aluminum silicate precipitated in situ,
0.2% by weight of fragrance,
0.2% by weight of formaldehyde, 30%,
balance water, fully deionized.

This abrasive-containing scouring agent, free from active chlorine, was produced in the same way as in Example 1, except that, due to the absence of the active chlorine compound, a pH-value of approximately 10 was adjusted by the gradual addition of dilute hydrochloric acid during precipitation of the calcium aluminum silicate and before addition of the waterglass. The suspension was still stable after 3 months.

EXAMPLE 8

8% by weight of sec. $C_{11}$–$C_{15}$-alkane sulfonate, Na-salt, 60% of active substance,
2% by weight of methacryl/ethyl acrylate copolymer, 20% aqueous dispersion,
5% by weight of chlorine bleaching liquor, 12 to 16% of active chlorine,
45% by weight of marble powder, average particle diameter 15μ,
5% by weight of calcium aluminum silicate precipitated in situ,
0.1% by weight of fragrance
balance water, fully deionized.

Production was carried out in the same way as in Example 1, the copolymer being added after the marble powder. A pH-value of 12.5 was adjusted by the addition of dilute hydrochloric acid before addition of the waterglass, remaining unchanged after completion of the liquid scouring agent.

The pourable, bleaching scouring agent was comparable both in its suspension stability and in its chlorine stability with the products of the preceding Examples.

The preceding specific embodiments are illustrative of the practice of the invention. It is to be understood however, that other expedients known to those skilled in the art or disclosed herein can be employed without departing from the spirit of the invention or the scope of the appended claims.

We claim:

1. A process for the production of a stable, aqueous cleaning agent composition comprising (a) a surfactant-effective amount of a surfactant selected from the group consisting of non-chlorine stable anionic surfaceants, non-chlorine stable nonionic surfactants, chlorine-stable anionic surfactants, chlorine-stable nonionic surfactants and mixture thereof, (b) from 0 to an abrasively-effective amount of at least one abrasive component, (c) from 0 to a bleaching-effective amount of an active-chlorine-releasing compound and (d) from 0 to an effective amount of dyes and (e) from 0 to an effective amount of fragrances, with (f) a further suspending-effective amount of an amorphous calcium aluminum silicate precipitated in situ, where an effective amount of at least one of component (b) and component (c) is present, comprising the steps of mixing component (b), if present, with an aqueous solution of component (a) and component (d) if present, at room temperature, then successively adding under continuous mixing a calcium chloride solution, an aluminum hydroxide solution and a waterglass solution in amounts sufficient to form said component (f) in situ, followed by adding component (c), if present, and component (e) if present, and recovering said stable, aqueous cleaning agent composition.

2. The process of claim 1 wherein said final composition consistent essentially of (a) from 1 to 10% by weight of component (a)
(b) from 0 to 60% by weight of component (b), having a particle size of from 1 to 200μ,
(c) from 0 to 10% by weight of component (c), as chlorine,
(f) from 5% to 20% by weight of component (f), and
(g) balance to 100% by weight of fully deionized water and, optionally, components (d) and (e), where at least one components (b) and (c) is present.

3. The process of claim 2 wherein said final composition consisting essentially of (a) from 2% to 6% by weight of component (a)
(b) from 10% to 50% by weight of component (b) having a particle size of from 1 to 100μ,
(c) from 0 to 10% by weight of component (c), as chlorine,
(f) from 5% to 15% by weight of component (f), and
(g) balance of 100% by weight of fully deionized water and, optionally, components (d) and (e).

4. The process of claim 3 wherein the stable, aqueous cleaning agent composition of claim 3 wherein component (c) is present in an amount of from 0.1% to 2% by weight as chlorine.

5. A stable, aqueous cleaning agent composition comprising (a) a surfactant-effective amount of a surfactant selected from the group consisting of non-chlorine-stable anionic surfactants, non-chlorine stable nonionic surfactants, chlorine-stable anionic surfactants, chlorine-stable nonionic surfactants and mixtures thereof, (b) from 0 to an abrasively-effective amount of at least one abrasive component, (c) from 0 to a bleaching-effective amount of an active-chlorine-releasing compound and (d) from 0 to an effective amount of dyes and (e) from 0 to an effective amount of fragrances, with (f) a further suspending-effective amount of an amorphous calcium aluminum silicate precipitated in situ, where an effective amount of at least one of component (b) and component (c) is present.

6. The stable, aqueous cleaning agent composition of claim 5 consisting essentially of (a) from 1% to 10% by weight of component (a)
(b) from 0 to 60% by weight of component (b), having a particle size of from 1 to 200μ,
(c) from 0 to 10% by weight of component (c), as chlorine,
(f) from 5% to 20% by weight of component (f), and
(g) balance of 100% by weight of fully deionized water and, optionally components (d) and (e), where at least one of components (b) and (c) is present.

7. The stable, aqueous cleaning agent composition of claim 5 consisting essentially of (a) from 2% to 6% by weight of component (a)
(b) from 10% to 50% by weight of component (b) having a particle size of from 1 to 100μ,
(c) from 0 to 10% by weight of component (c), as chlorine,
(f) from 5% to 15% by weight of component (f), and
(g) balance to 100% by weight of fully deionized water and, optionally, components (d) and (e).

8. The stable, aqueous cleaning agent composition of claim 7 wherein component (c) is present in an amount of from 0.1% to 2% by weight as chlorine.

* * * * *